US005483265A

United States Patent [19]

Kneezel et al.

[11] Patent Number: 5,483,265

[45] Date of Patent: Jan. 9, 1996

[54] MINIMIZATION OF MISSING DROPLETS IN A THERMAL INK JET PRINTER BY DROP VOLUME CONTROL

[75] Inventors: Gary A. Kneezel; Joseph J. Wysocki, both of Webster; Joseph F. Stephany, Williamson; Thomas E. Watrobski, Penfield; Richard V. LaDonna, Fairport; Dale R. Ims, Webster; Ivan Rezanka, Pittsford; W. Conrad Richards, Marion, all of N.Y.

[73] Assignee: Xerox Corporation, Stamford, Conn.

[21] Appl. No.: 176,389

[22] Filed: Jan. 3, 1994

[51] Int. Cl.[6] ..... B41J 2/05

[52] U.S. Cl. ..... 347/14; 347/92

[58] Field of Search ..... 347/14, 92, 17

[56] References Cited

U.S. PATENT DOCUMENTS

| | | | |
|---|---|---|---|
| 4,313,684 | 2/1982 | Tazaki et al. | 347/37 |
| 4,345,262 | 8/1982 | Shirato et al. | 347/57 X |
| 4,352,114 | 9/1982 | Kyogoku | 347/14 |
| 4,638,337 | 1/1987 | Torpey | 347/65 |
| 4,746,931 | 5/1988 | Okuda | 347/192 X |
| 4,774,530 | 9/1988 | Hawkins | 347/63 |
| 4,860,034 | 8/1989 | Watanabe et al. | 347/14 |
| 4,980,702 | 12/1990 | Kneezel et al. | 347/17 |
| 5,023,626 | 6/1991 | Kawamura | 347/14 |
| 5,036,337 | 7/1991 | Rezanka | 347/14 |
| 5,168,284 | 12/1992 | Yeung | 347/17 |
| 5,223,853 | 6/1993 | Wysocki et al. | 347/14 |
| 5,300,968 | 4/1994 | Hawkins | 347/14 |

*Primary Examiner*—Joseph W. Hartary
*Attorney, Agent, or Firm*—Oliff & Berridge

[57] ABSTRACT

A thermal ink jet printhead is controlled to minimize missing droplets at elevated operating temperatures by varying the voltage and pulse width applied to the heater element that causes droplets to be formed and ejected. Increasing the applied voltage reduces the size of the formed droplets. At increased operating temperatures, smaller droplets minimize the introduction of air into the nozzles of the printhead upon ejection. Minimizing the introduction of air eliminates printhead misfirings and causes more consistent jetting of the ink droplets.

25 Claims, 11 Drawing Sheets

MINIMIZATION OF MISSING DROPLETS IN A THERMAL INK JET PRINTER BY DROP VOLUME CONTROL

BACKGROUND OF THE INVENTION

1. Field of the Invention

This invention relates to thermal ink jet printers and, more particularly, the control of ink droplets ejected from thermal ink jet printheads to enhance the quality of printing.

2. Description of Related Art

A thermal ink jet printhead selectively ejects droplets of ink from a plurality of drop ejectors to create a desired image on an image receiving member. The printhead typically comprises an array of drop ejectors that convey ink to the image receiving member. The printhead moves back and forth relative to the image receiving member to print the image. Alternatively, the array may extend across the entire width of the image receiving member. In either case, the image receiving member moves perpendicularly relative to the linear array of the printhead. The ink drop ejectors typically comprise ink passageways, such as capillary channels, having a nozzle end and are connected to one or more ink supply manifolds. Ink from the manifold is retained within each channel until, in response to an appropriate signal, the ink in the channel is rapidly heated and vaporized by a heater element disposed within the channel. Rapid vaporization of some of the ink creates a bubble that causes a quantity of ink or droplet to be ejected through the nozzle to the image receiving member. U.S. Pat. No. 4,774,530 to Hawkins shows the general configuration of a typical ink jet printhead.

The droplet ejected from the ejector to the image receiving member forms a spot of ink, which is part of the desired image. The human eye is very sensitive to changes in spot size, especially when shaded areas and graphics are being produced and especially for color printing. Therefore, uniformity of spot size of a large number of droplets is crucial to maintaining image quality in ink jet printing. If the volume of ejected droplets varies greatly within a single image, the lack of uniformity in droplet volume will noticeably affect the size of the ink spots forming the image and detract from the quality and color of the image. Similarly, if volumes of droplets ejected from the printhead differ during subsequent printings of the same image, then printing consistency cannot be maintained. Consistency is particularly important in color printing, where the resultant colors are highly dependent on the volume ratios of the ejected droplets that combine to produce the desired colors.

In addition to variations in spot size, one of the most objectionable printing defects is white striping in the image due to one or more channels of the printing device failing to operate properly. In a thermal ink jet printhead, channels can fail due to heater failure, channel plugging, air blockage in the rear of the channel, or air over the heater. Air in the channel region over the heater can occur from a variety of sources, including exsolved air from the ink, air leaks in the ink seal to the device, and air entering through the nozzle openings. Air will enter through the nozzle openings when too much ink is expelled during firing of a channel, causing air to be sucked in around the ink meniscus during bubble collapse and become trapped in the heater region or in the ink pathway leading to the heater. A thermal ink jet printhead requires that ink be in direct contact with the heater so that a vapor bubble can be formed to propel the next droplet of ink to properly function. If any significant amount of air covers the heater, the vapor bubble will not be formed properly, and the printhead will misfire. In addition, if an air bubble is trapped in the ink pathway leading to the heater, it will inhibit refill of the channel. Further, as a printhead warms up, due to changes in ambient temperature or due to heat generated by the printing process, the ink viscosity decreases. As a result, droplet volume increases with temperature so that missing droplets due to air entering the nozzles becomes more prevalent at elevated temperatures.

Several prior art devices have attempted to control the temperature of the heater to control the droplet and subsequent spot size.

For example, U.S. Pat. No. 4,980,702 to Kneezel et al. discloses a temperature control system that utilizes a control circuit that regulates heater operation to maintain the printhead in a desired operating range.

However, controlling the temperature of the heater is difficult to achieve a constant temperature range and requires large feedback time to sense the temperature, regulate the heater and check the regulated temperature.

To overcome the difficulties of directly controlling the temperature of the heater, U.S. Pat. No. 5,223,853 to Wysocki et al. proposes selectively applying an electrical input signal having an amplitude and time duration to the heater element to affect the size of the ejected ink droplet.

It is known that the size of a discharged droplet is determined by various controlling factors such as electrical energy quantity as discussed in U.S. Pat. No. 4,345,262 to Shirato et al. However, none of the prior art patents disclose a method or apparatus for reducing the occurrence of missing droplets, particularly at elevated operating temperatures.

SUMMARY OF THE INVENTION

Accordingly, it is a primary object of this invention to minimize the occurrence of missing droplets at elevated operating temperatures of a printhead.

It is also an object of this invention to decrease the introduction of air in an ink channel to prevent misfiring of ink droplets from the printhead.

A further object of this invention is to reduce the occurrence of missing ink droplets with a simplified assembly and at a low cost.

An additional object of the invention is to control the droplet size of ejected ink in a thermal ink jet printhead at elevated temperatures.

To achieve the above and other objects, this invention proposes a method of inhibiting air from entering nozzles in an ink jet printhead, which causes missing ink droplets, during printing by an ink jet printhead at elevated temperatures. The method comprises the steps of sensing a temperature of the printhead and controlling ink droplet size to minimize air entering the printhead nozzles by controlling the voltage and the pulse width of the power applied to the printhead responsive to the sensed temperature. The method controls the ink droplet volume by increasing the voltage, or more generally the power, applied to the printhead when the temperature of the printhead is in a range higher than an average operating temperature. As a result, droplet sizes produced at such elevated temperatures are nominally the same as at an average operating temperature, and air entering the printhead is minimized.

The invention also proposes an apparatus for minimizing missing droplets ejected from a thermal ink jet printhead comprising a temperature sensor that senses a temperature of the printhead and a controller that controls power supplied to the printhead for actuating ink droplet ejection. The controller increases the voltage applied to the printhead in response to increased sensed temperatures based on a predetermined relationship between voltage and temperature.

Other objects, advantages and salient features of the invention will become apparent from the following detailed description taken in conjunction with the annexed drawings, which disclose preferred embodiments of the invention.

DETAILED DESCRIPTION OF PREFERRED EMBODIMENTS

For purposes of background information on generally controlling spot size with electrical input signals, U.S. Pat. No. 5,223,853 to Wysocki et al. is hereby incorporated into this specification by reference.

As set forth in the preceding background discussion, the operating characteristics of a thermal ink jet printer are affected by variations in the temperature of the printhead. If the printhead temperature is too low, print quality defects due to erratic jetting, poor character definition, and low print density may result; if the temperature is too high, print quality defects due to resolution loss, inadequate drying or erratic operation can occur. The temperature range in which erratic operation may occur is relatively large (i.e. 10°–70° Celsius (C)). Within this large temperature range is a smaller range that provides good print quality. This is smaller range may be affected by variations in printhead and ink design, but experience has shown that this smaller range is generally 10°–20° C. As printhead temperature moves outside this smaller temperature range, print quality degrades. In particular, as the printhead temperature falls below the minimum in the smaller range, print quality suffers from poorly-filled characters and low print density. As the printhead temperature rises above the maximum in the smaller range, print quality suffers from line broadening and loss of print resolution. Since printing is effected by applying electrical heating pulses to the selected heater elements, the act of printing results in increases in printhead temperature. Continuous high density printing can therefore result in printhead temperature increasing beyond the acceptable range.

Figure 1A:
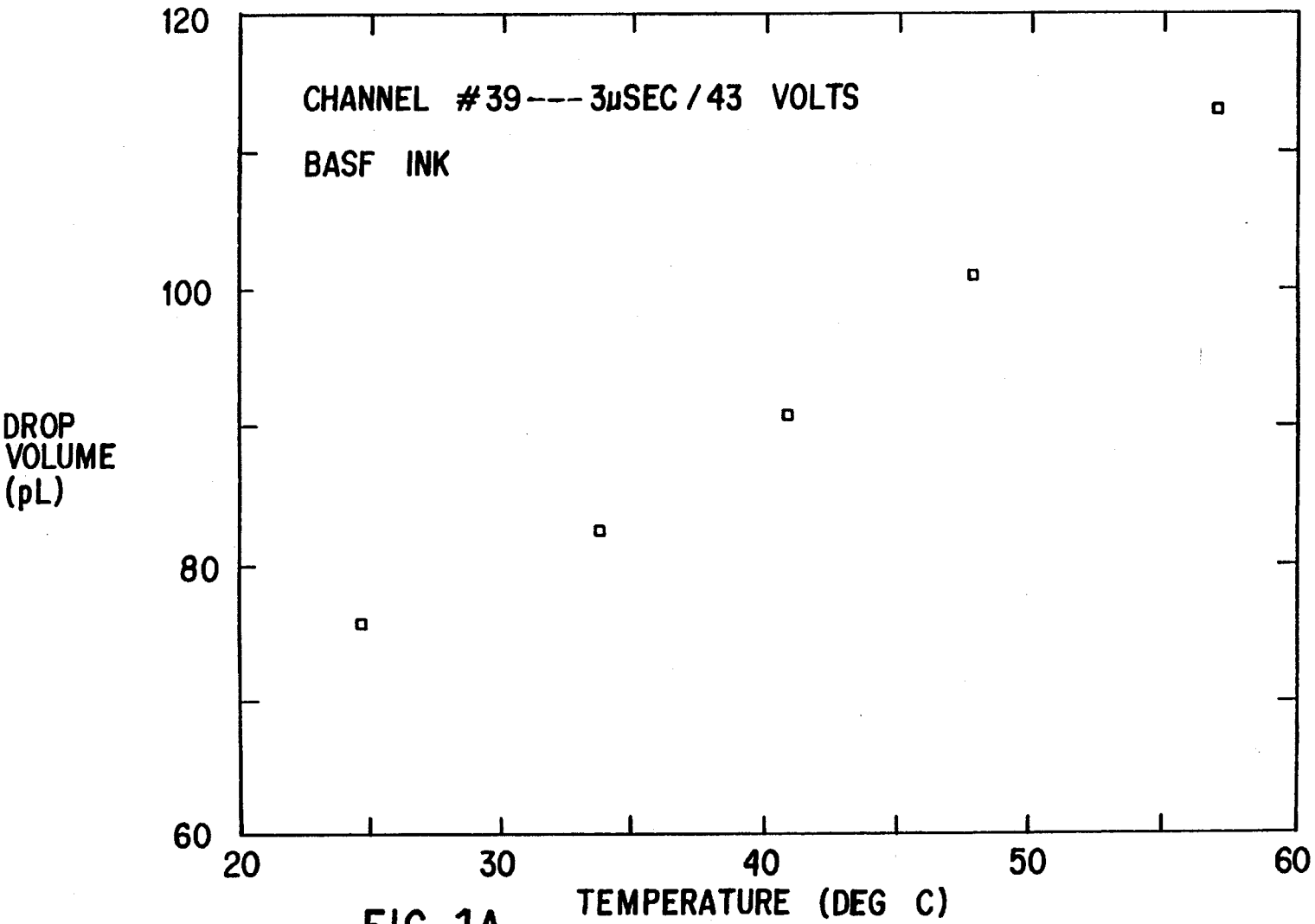
FIG. 1A is a graph illustrating variations in ink droplet volume with printhead temperature.

FIG. 1A is a graph illustrating variations in printhead temperature and the corresponding ejected ink droplet volume. Variations in droplet volume result in corresponding variations in the size of the spot produced by the impact of the ink droplet with the receiver sheet. The thermal ink jet printhead is designed to produce ink droplets of a size that allows overlap of the spots on the receiver sheet so that white spaces do not remain in areas that should be fully covered. If the droplet volume is insufficient to allow full coverage, print density will be unacceptably low and characters will look ragged. On the other hand, if droplet volumes are so large as to make spots on the receiver sheet much larger than required for full coverage, printing resolution will be lost, and ink drying times on the sheet will be excessive.

Figure 1B:
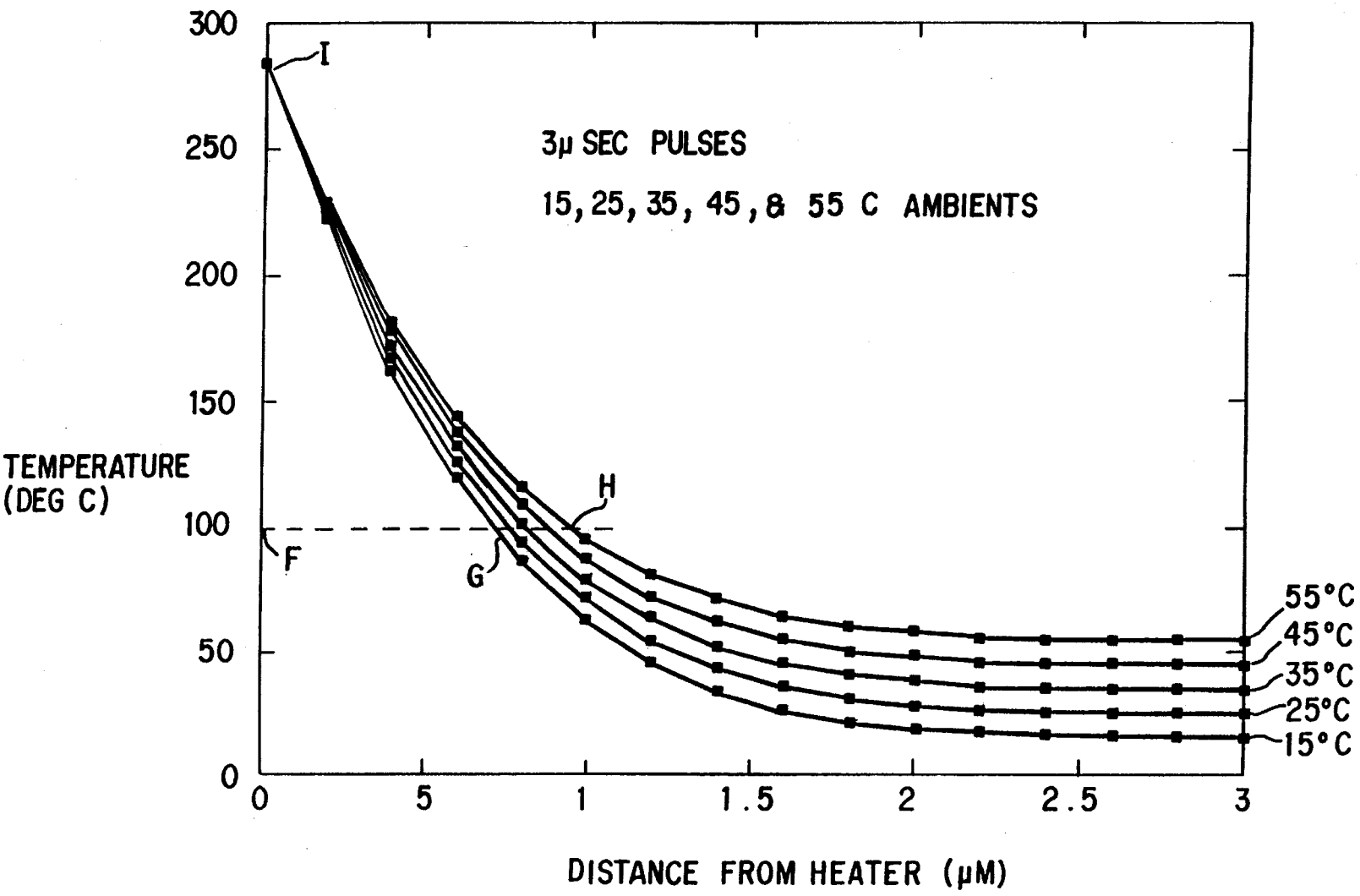
FIG. 1B is a graph illustrating the temperature profiles in the ink layer adjacent to the heater element for different printhead temperatures.

Droplet volume varies with temperature. This phenomenon is explained below with respect to the formation of an ink droplet. FIG. 1B shows a graph of the temperature in the ink layer over the thermal ink jet printhead's heater element at the instant when the ink layer immediately adjacent the heater element reaches the nucleation temperature. In this figure, the ink temperatures are shown as a function of the distance from the heater surface at different ambient temperatures. For a typical waterbased ink, the nucleation temperature is about 280° C. Nucleation temperature as used here is the temperature at which the liquid ink bursts into vapor (a vapor bubble nucleates or begins from nothing).

Initially, the ink is uniformly at the ambient temperature. When electrical power is applied to the heater element adjacent to the ink layer, the temperature of the heater element begins to increase. The ink layer immediately adjacent to the heater is heated by heat flowing from the heater into the cooler ink layer. Those skilled in the art will recognize that transient heat flow into an extended medium gives rise to temperature profiles. As shown in FIG. 1B, when the ambient temperature is higher, the temperature profiles at the time of nucleation move upward and pivot counter-clockwise about the 280° C. nucleation temperature. Thus, at some given distance from the heater element at the time that the heater/ink interface reaches the nucleation temperature, the temperature will be higher for the case wherein the ambient temperature is higher.

When the ink layer in contact with the heater element reaches the nucleation temperature, it bursts into vapor. The vapor layer or bubble is initially very thin, but its high internal pressure causes it to expand rapidly. More liquid may evaporate at the liquid/vapor interface on the side of the vapor layer opposite the heater element, but the heater element is isolated from the liquid ink by the (expanding) vapor bubble. The low thermal conductivity of the vapor bubble prevents any substantial heat flow from the heater to ink layer. However, the vapor bubble can continue to be fed by vaporization at the liquid/vapor interface as long as there is thermal energy available to supply the heat of vaporization for the liquid changing phase. The heat stored in the ink layer adjacent to the heater element prior to the vapor bubble nucleation provides this thermal energy as indicated in FIG. 1B. However, not all the thermal energy stored in the heated layer is available to drive further vaporization. Only those layers where the temperature exceeds the ink's boiling temperature can provide heat to drive further evaporation.

For water-based inks, the boiling temperature (at atmospheric pressure) is approximately 100° C. FIG. 1B delineates the areas of the respective temperature profiles above the 100° C. point as shown by the dashed line F, G and H. These super-heated water layers in the ink provide the heat energy that drives the growth of the vapor bubble, which, in turn, expels the droplet of ink in thermal ink jet printers. The energy stored in the super-heated water layers is proportional to the areas bounded by the y-axis, the temperature profile curves, and the dashed line parallel to the x-axis at 100° C. in FIG. 1B. For example, the area for the 55° C. ambient temperature curve is bounded by points F, H and I, and the area for the 25° C. ambient temperature curve is bounded by the points F, G and I. Thus, a higher ambient temperature (FIG. 1B) results in a larger area as defined above and a larger stored energy to drive the bubble growth.

Thus, while there may be other contributing factors, thermal ink jet printheads produce larger droplet volumes (and spots on paper) when printhead temperature increases because there is more energy stored in the super-heated water layer. It is that stored energy that drives the process.

Figure 2A:
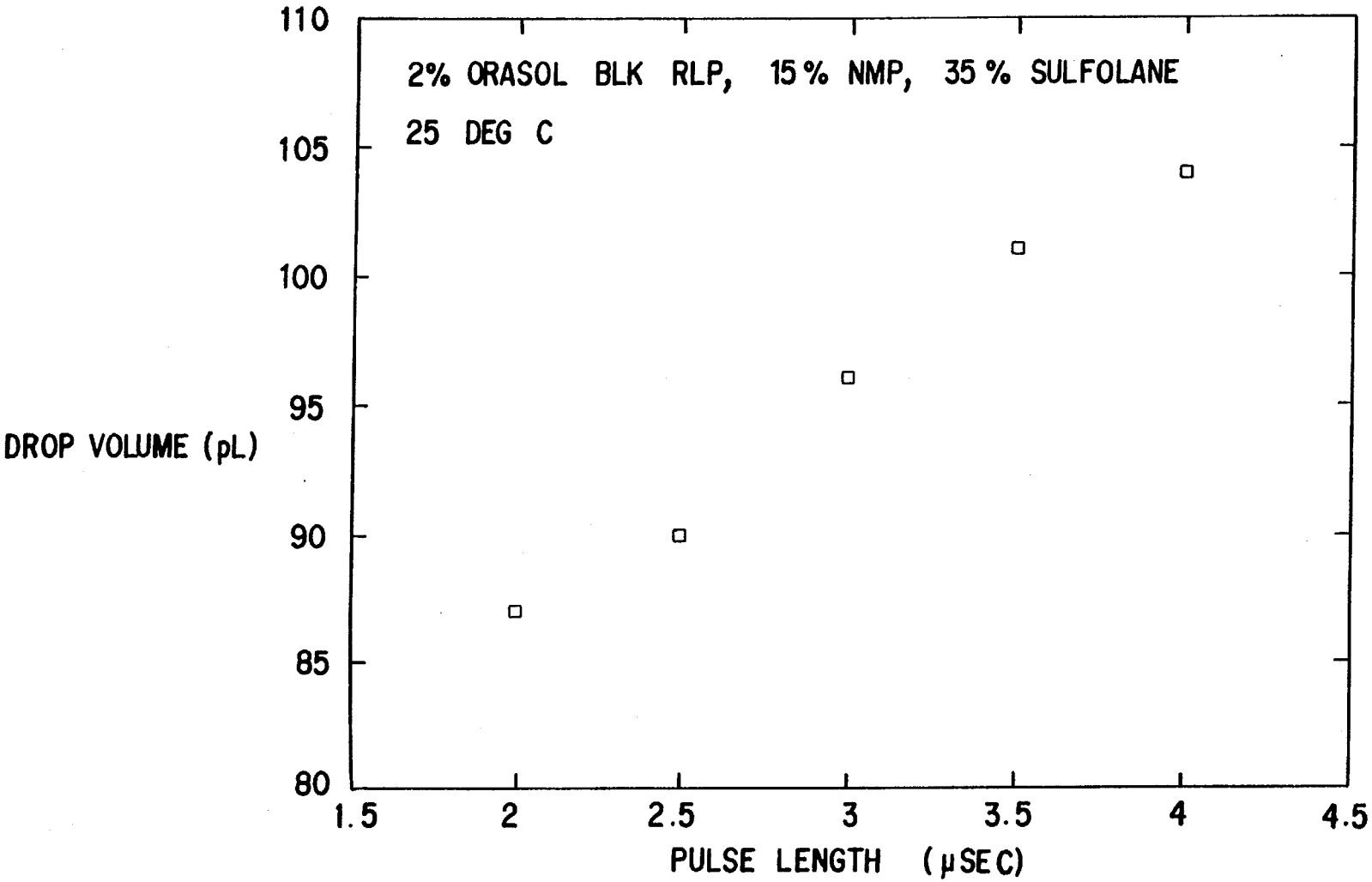
FIG. 2A is a graph illustrating variations in ink droplet volume with pulse duration.
Figure 2B:
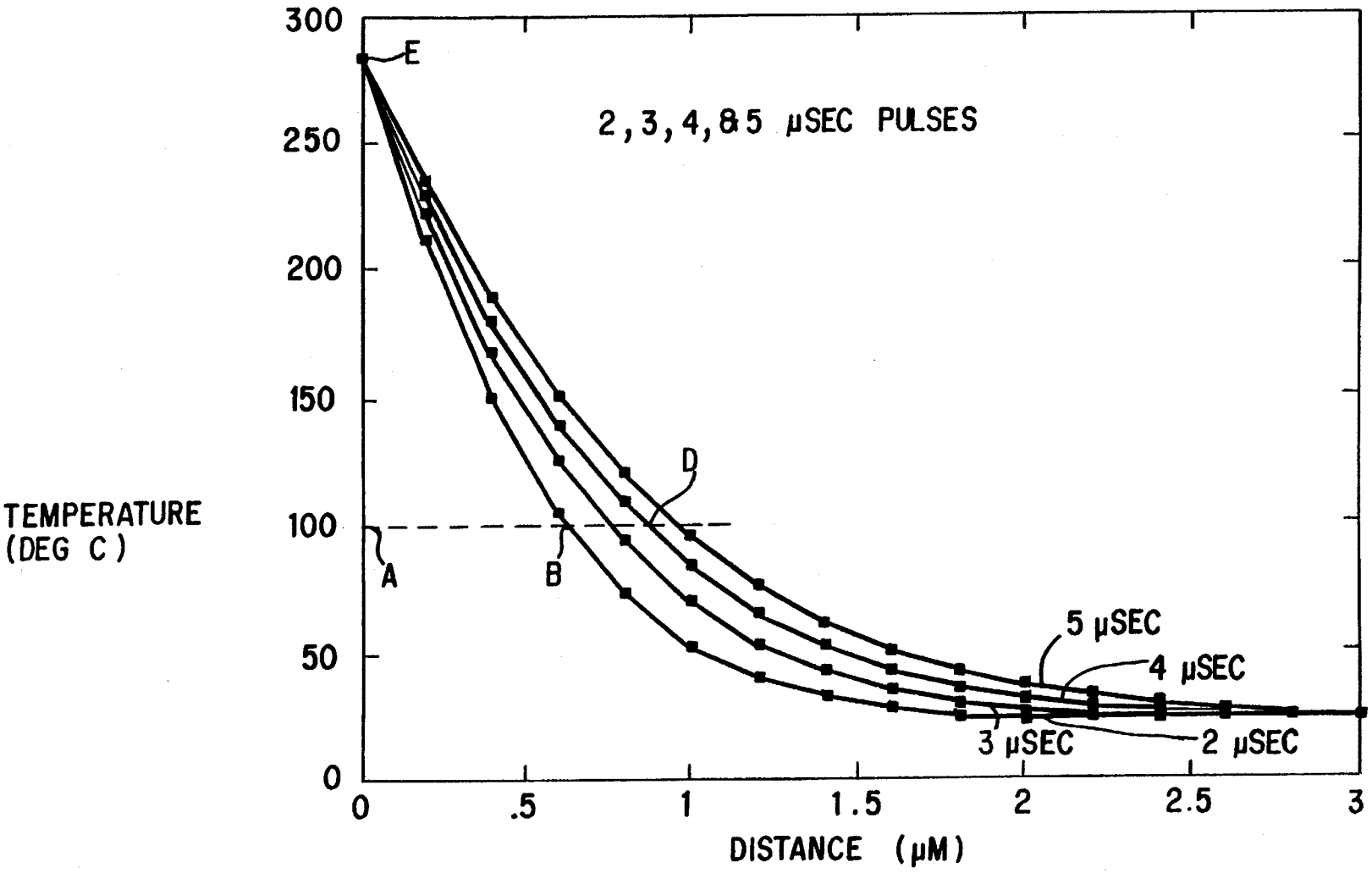
FIG. 2B is a graph illustrating the temperature profiles in the ink layer adjacent to the heater element for different pulse durations.

The graph of FIG. 2A shows the experimental results of measuring the droplet volumes produced by a thermal ink jet printhead when the ambient temperature is held constant and the duration of the driving pulse to the heater element is varied. As indicated in FIG. 2A, short duration driving pulses result in smaller droplet volumes, and longer duration driving pulses result in larger droplet volumes. The variation in droplet volume with driving pulse duration are explained by the temperature profiles shown in FIG. 2B in the ink layers adjacent to the heater element at the instant in time when the ink layer immediately adjacent to the heater element reaches the nucleation temperature (280° C.). In FIG. 2B, the ambient temperature is held constant (25° C.), and the curves represent different driving pulse durations. Longer duration driving pulses result in a greater quantity of heat energy stored in the super-heated water layer than the shorter duration driving pulses as indicated by FIG. 2B. For example, a 4 microsecond pulse area, bounded by points A, D and E, is greater than a 2 microsecond pulse area, bounded by points A, B and E. Thus, the greater quantity of heat stored in the superheated water layer for the longer duration driving pulses results in a larger vapor bubble subsequent to nucleation and a larger droplet volume. Conversely, for a shorter duration driving pulse, the smaller quantity of heat stored in the super-heated water layer results in a smaller droplet volume.

At first blush, it would seem to be obvious to control droplet volume over variations ,in printhead temperature by measuring the printhead temperature and adjusting the duration of the driving pulse to compensate for printhead temperature variations as shown in FIG. 2A. Thus, as the printhead temperature increases due to printing demand or rising ambient temperature, the driving pulse duration would be decreased. Conversely, as printhead temperature decreases due to low printing demand or reductions in ambient temperature, the driving pulse duration would be increased.

Figure 3:
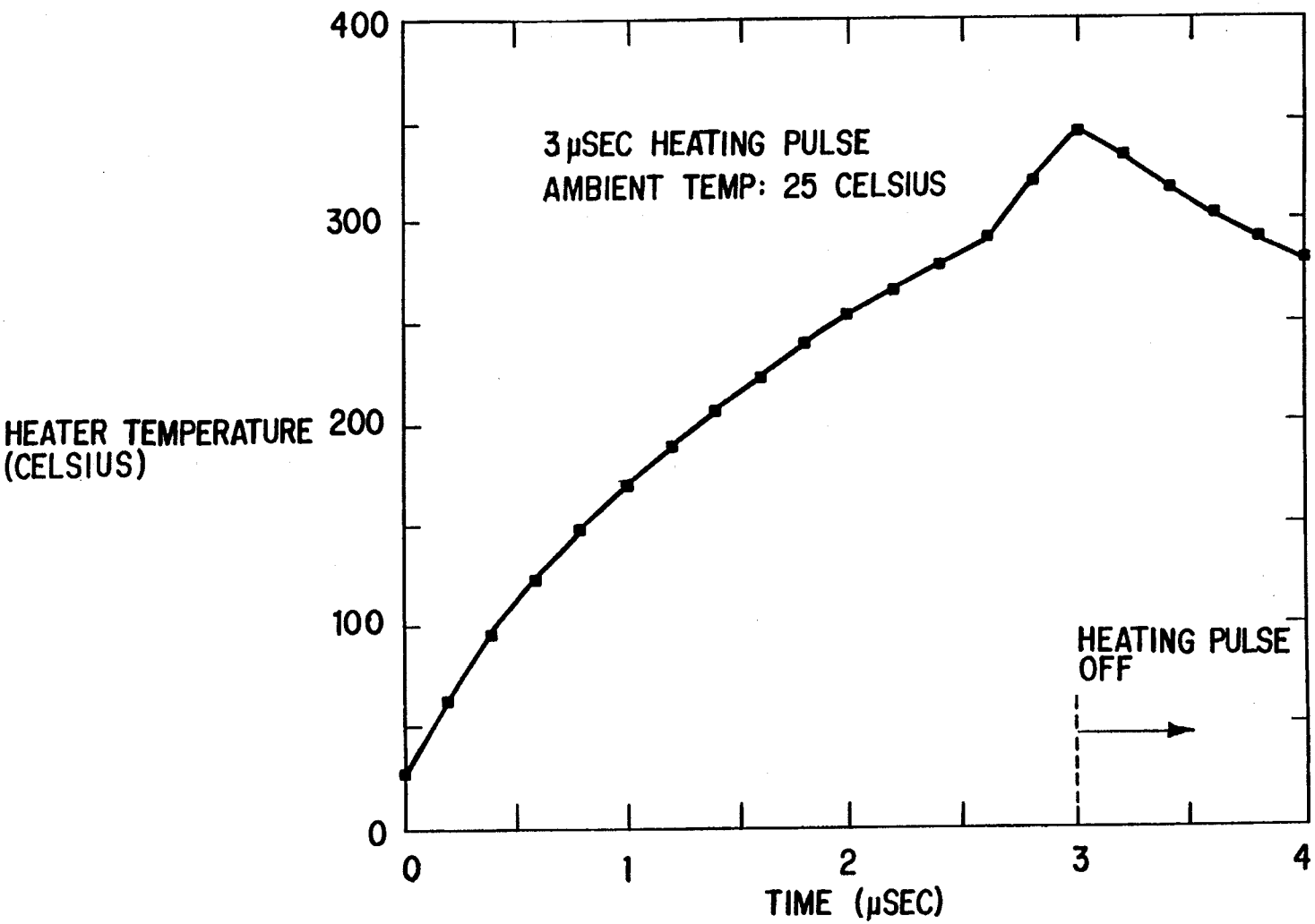
FIG. 3 is a graph illustrating the heater surface temperature as a function of time.

However, when the above control scheme is applied to a thermal ink jet printer, it is found that it is not effective in holding spot size constant over variations in printhead temperature and that the printhead fails to produce ink droplets when the printhead temperature exceeds a certain value. Referring to FIG. 3, the heater element temperature is plotted against time for a particular power level. The preceding control result may be explained because the heater element temperature begins at the ambient temperature (25° C.) at time=where the heating pulse begins and the heater element temperature continues to increase during the time that the heating pulse is on. As shown in FIG. 3, the heater temperature initially increases rapidly as time increases, but the time rate of change of temperature decreases as time progresses. Then, when the ink in contact with the heater element vaporizes as the temperature reaches the nucleation temperature, the low thermal conductivity of the vapor bubble prevents significant heat ,flow to the ink layer and the rate of change of temperature decreases as shown by the time rate of change in heater temperature increasing at about 3 μsec. Thus, the heat that has been flowing to the (liquid) ink layer in contact with the heater remains in the heater element and causes its temperature to rise. (There is, of course, still heat flow from the heater element to the supporting structures below.) Therefore, due to the low thermal conductivity of the vapor bubble, continued application of power to the heater element after the vapor bubble has formed has no affect on the growth of size of the vapor bubble or, therefore, the size of the droplet produced by the printhead.

It is seen, then, that simply increasing driving pulse duration to a thermal ink jet printhead does not result in the desired effect of increasing the emitted droplet volume. Also, those skilled in the art will recognize that if the driving pulse duration is reduced to 2 [sec, the temperature of the heater element will not reach the required nucleation temperature, and no vapor bubble or ink droplet will be produced.

Figure 4:
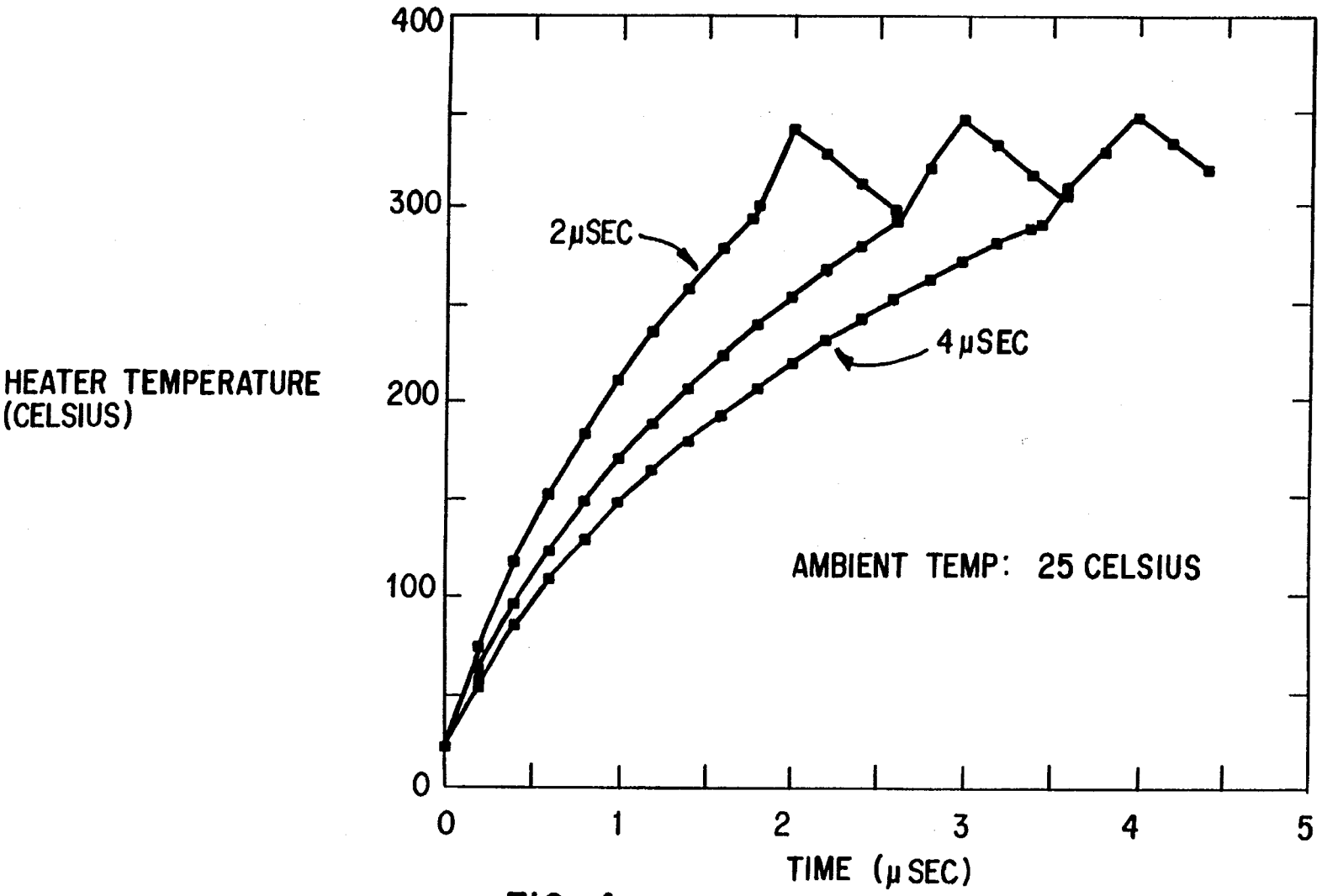
FIG. 4 is a graph illustrating the heater surface temperature with different pulse durations and power levels.

FIG. 4 is a graph of the thermal ink jet heater element temperature as a function of time showing curves for three different power levels (voltages) applied to the heater. As can be recognized, the heating pulse durations ;are different for the different power levels. For example, the highest input power level corresponds to curve for a 2 μsec pulse duration. The curves show the characteristic rapid rise in heater temperature near the end of the heating pulse, which signals formation of the vapor bubble. It is this heating time prior to vapor bubble nucleation that controls the amount of energy stored in the super-heated ink layer at a given temperature. Thus, by controlling the driving pulse duration and power level in combination, the desired control of vapor bubble nucleation time and energy storage in the super-heated ink layer at a given temperature is achieved. As a result of this control of the energy storage, the droplet volume may be held constant in spite of variations in printhead temperature.

It is thus noted that the invention entails a change in pulse power or voltage along with pulse duration since the time required to reach the nucleation temperature is dependent on power. For example, since more energy is available for a given printhead ambient temperature with a longer pulse duration and since more energy is available for a given pulse duration with a printhead having an increased ambient temperature, one can trade off the variations for a given printhead temperature to couple a shortened pulse duration with an increased voltage to achieve the nucleation temperature near the end of the heating pulse without application of excess energy. In other words, a relatively short pulse requires relatively high voltage, and a relatively long pulse requires relatively low voltage.

Figure 5:
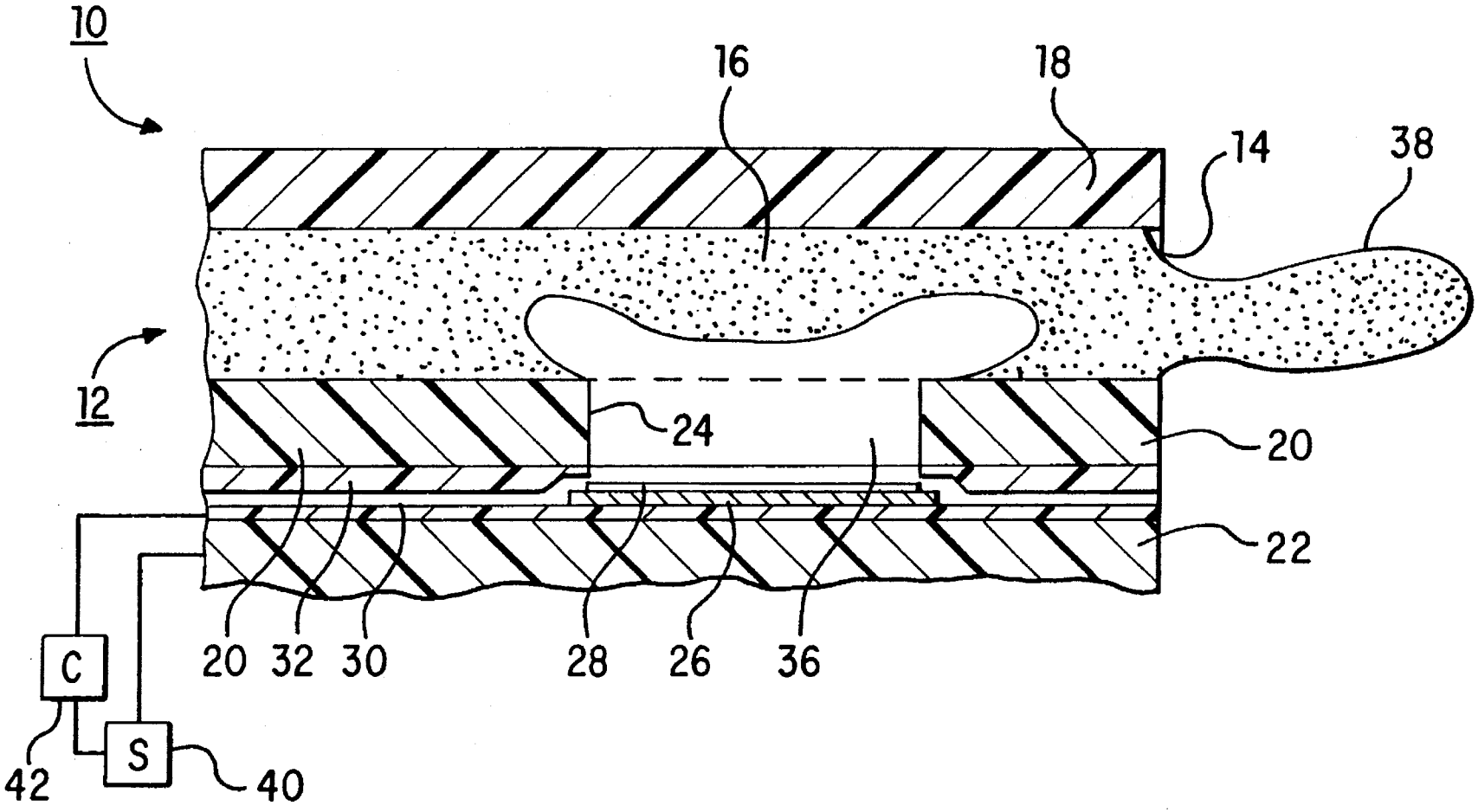
FIG. 5 PRIOR ART
FIG. 5 is a side sectional view of a conventional thermal ink jet printhead during formation and ejection of an ink droplet.

FIG. 5 shows a droplet ejector of a conventional thermal ink jet printhead. Normally, a plurality of such ejectors would be found in an ink jet printhead, particularly as applied to the present invention. Typically, such ejectors are sized and arranged in linear arrays of 300 ejectors per inch (spi). However, other resolutions above 300 spi have also been fabricated. Preferably, a silicon member with a plurality of droplet ejector channels defined therein, typically 128 ejectors, is used as a die module or chip.

A thermal ink jet apparatus may have a single print bar extending the full width of an image receiving member on which an image is to be printed, such as 8½ inches or more The print bar is constructed from a large number of individual die modules or chips, each with a different sensitivity to temperature. Alternatively, many systems comprise smaller chips that are moved across an image receiving member in the manner of a typewriter or comprise a plurality of chips abutted across the entire substrate width to form the full width printhead. In full width print bar and color printer designs with multiple chips, each chip may include its own ink supply manifold or multiple chips may share a single common ink supply manifold. Even when many chips share one ink supply, ink is heated substantially after it enters the die module before ejection.

Each thermal ink jet chip or ejector, generally indicated as 10, includes a capillary channel 12 that terminates in an orifice 14 or nozzle. The channel 12 regularly holds a quantity of ink 16 until such time as a droplet of ink is to be ejected. Each of the plurality of capillary channels 12 are maintained with a supply of ink from an ink supply manifold (not shown). In the ejector shown in FIG. 5, the main portion of channel 12 is defined by a groove anisotropically etched in an upper substrate 18 that is made of crystalline silicon, The upper substrate 18 abuts a thick film layer 20, which in turn abuts a lower substrate 22.

Sandwiched between the thick film layer 20 and the lower substrate 22 are electrical elements that cause the ejection of a droplet of ink from the capillary channel 12. A heater element 26 is positioned within a recess 24 formed in the thick film layer 20. The heater element 26 is typically protected by a protective layer 28 made of, for example, a tantalum layer having a thickness of about 1 micron. The heater element 26 is electrically connected to an addressing electrode 30. Each of the ejectors 10 in a printhead has its own heater element 26 and individual addressing electrode controlled selectively by control circuitry. The addressing electrode 30 is typically protected by a passivation layer 32.

When an electrical signal is applied to addressing electrode 30 to energize the heater element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 and ejected onto the surface of an image receiving member. The image receiving member has an image receiving surface on which the droplet 38 is deposited to form an ink spot or mark. The image is formed by a plurality of ink spots or marks. The image receiving member may be, for example, a sheet of paper or a transparency.

As mentioned above, the size of the spot created by a droplet 38 on an image receiving member is a function of both the physical qualities of density and viscosity of the ink at the point just before vaporization, which is largely a function of the temperature of the ink, and the kinetic energy with which the droplet is ejected, which is a function of the electrical energy provided to the heater element 26.

In operation of droplet ejector 10 as shown in FIG. 5, droplets are ejected from the ejector 10 by activating a heater element 26 as discussed above. To obtain a desired spot size, it is necessary to take into account the temperature of the liquid ink at the moment before ejection. However, the very act of ejection itself causes a general increase in temperature around the ejector 10 because of the activation of the heater element 26. Some of this added heat escapes with the ejected ink itself, but a significant portion is retained in the ejector. Over even a short period of use, the temperature of the ejector 10, and therefore the temperature of the ink flowing into the ejector 10, will increase substantially.

A temperature sensor 40 is coupled to ejector 10 to monitor the temperature of ejector 10. Sensor 40 may be a thermistor fabricated as part of the thermal ink jet chip. However, a variety of known thermal sensors either on the chip or off the chip may be used. Sensors on the chip have a faster response to temperature changes in the region of interest. However, sensors thermally near the chip, but not actually part of the chip, are also suitable for the application of minimizing air ingestion into ink channel 12. In particular, sensors bonded to the printhead substrate or integrated as part of the substrate, such as in U.S. Pat. No. 4,980,702, are suitable. As a further alternative, a thermal sensor that is not in contact with the printhead may be used to sense ambient temperature. Then, the printing data would be used to estimate the temperature rise of the printhead above ambient.

Temperature sensor 40 is coupled to a controller 42, which can be in the form of a microprocessor. Controller 42 regulates the voltage and pulse width applied to heater element 26 to reduce the occurrence of missing droplets at elevated printhead temperatures.

As discussed above, spot size, or droplet volume, can be controlled independently of the printhead temperature (over a range of 25° C. or more) by applying predetermined combinations of voltage and pulse width for the heater element pulse. Such spot size control can significantly reduce the occurrence of missing droplets because shorter pulse width and higher voltage have been experimentally shown to produce smaller ink droplets as discussed above. Accordingly, at higher temperatures, when the viscosity of the ink decreases and drop volume increases causing air to be sucked into ink channel 12 upon droplet ejection, the voltage can be increased to reduce drop volume and prevent air from being introduced into ink channel 12. Thus, missing ink droplets due to air trapped in ink channel 12 are minimized.

When a new printhead is designed, the resulting spot size or droplet volume at a variety of temperatures for a variety of pulse widths and voltages are measured and recorded. Preferably, the voltage is chosen to be 10% over the threshold voltage for a given pulse width. The threshold voltage is the voltage at which droplets begin to be ejected.

The preferred pulse conditions have been carefully selected to have a high enough voltage so that droplets are reliably ejected, but a low enough voltage so that ink is not baked onto the heater element 26 (kogation). Nominally, a given pulse width is selected. Then, the voltage of the pulse is gradually increased until droplets just begin to be ejected. This is the threshold printing voltage. The ideal pulse voltage for printing is on the order of 10% greater than the threshold voltage. The printing voltage should be between 2% and 25% greater than the threshold voltage, and preferably 7% to 20% greater than the threshold voltage. Due to manufacturing tolerances, not all printheads have the same printing threshold voltage. However, preferably the printing voltage is nominally about 10% above the threshold voltage.

This same approach is used to construct a look-up table to keep too much drop volume from being ejected at higher temperatures. Using a predetermined relationship of printing voltage and threshold voltage, a look-up table is created for pulse width and voltage versus temperature.

Figure 6:
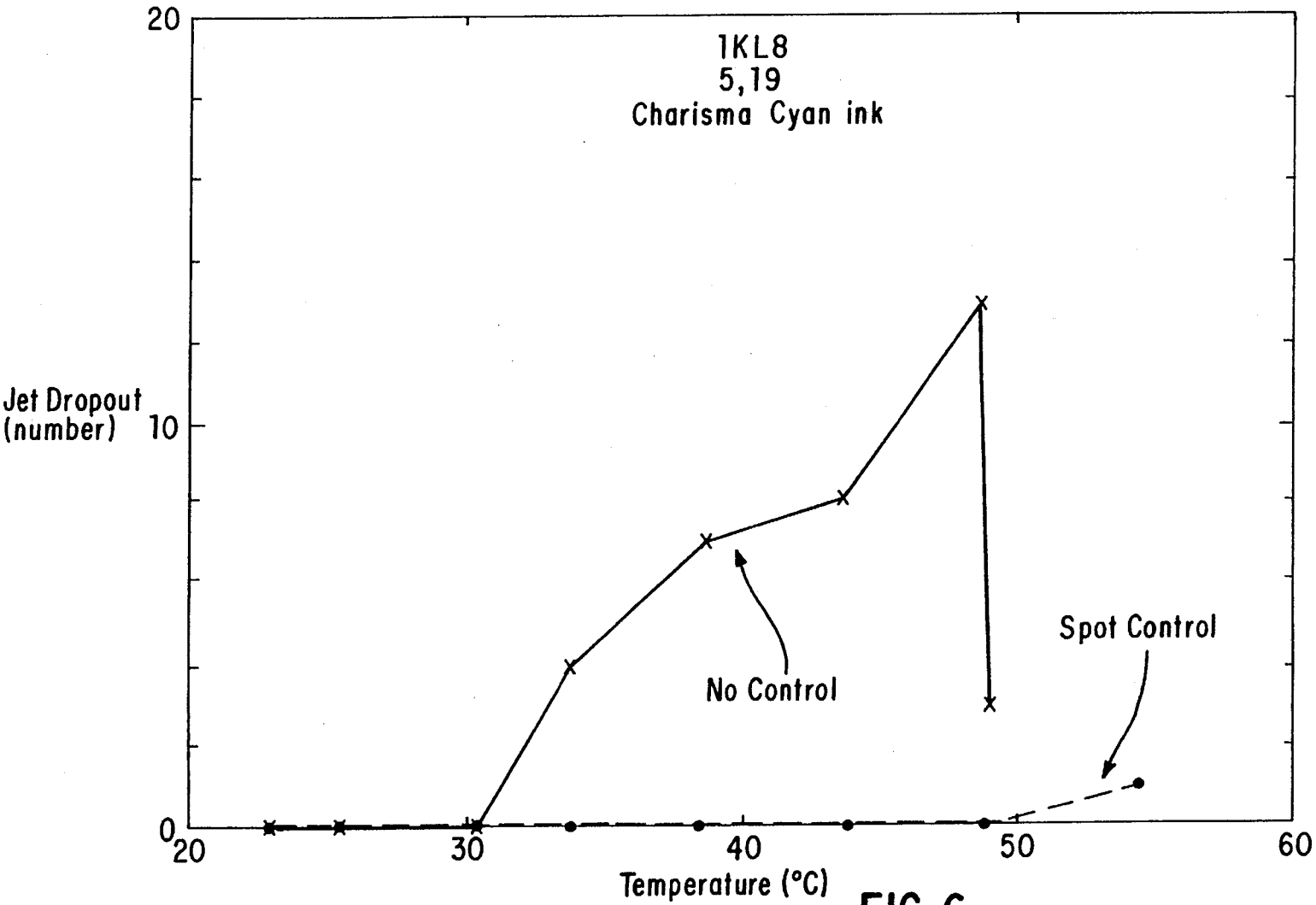
FIG. 6 is a graph of ink jet droplet dropout (missing droplets) versus the temperature of the printhead for a printhead with no control (solid line) and a printhead with control (dashed line) according to one embodiment of this invention.

As shown in FIG. 6, this predetermined relationship that increases the voltage with increasing temperature significantly reduces the occurrence of missing droplets. FIG. 6 illustrates the results of an experiment using an ink (Charisma cyan) that tends to give large droplets compared to the P2A ink for which the experimental printhead's drop generator was sized. Hence, this experiment exaggerates the amount of jet dropout or missing droplets normally seen at a given temperature. In particular, for this printhead and ink combination, the uncontrolled spot size increases 0.75 micron per ° C. from 140 micron diameter at 22° C. to 164 micron diameter at 54° C. The desired spot size for 300 spi printing is approximately 130 microns. The look-up table used for this experiment controlled the spot size to 131 microns, which essentially eliminated jet dropout.

Using such a predetermined relationship between the voltage and temperature for droplet volume, the average spot size can also be controlled with ±1 micron. With no control of the energy applied to the heater element, the spot size will change by approximately 25 microns (20%) over a 25° C. range for a 300 spi printhead.

Figure 7:
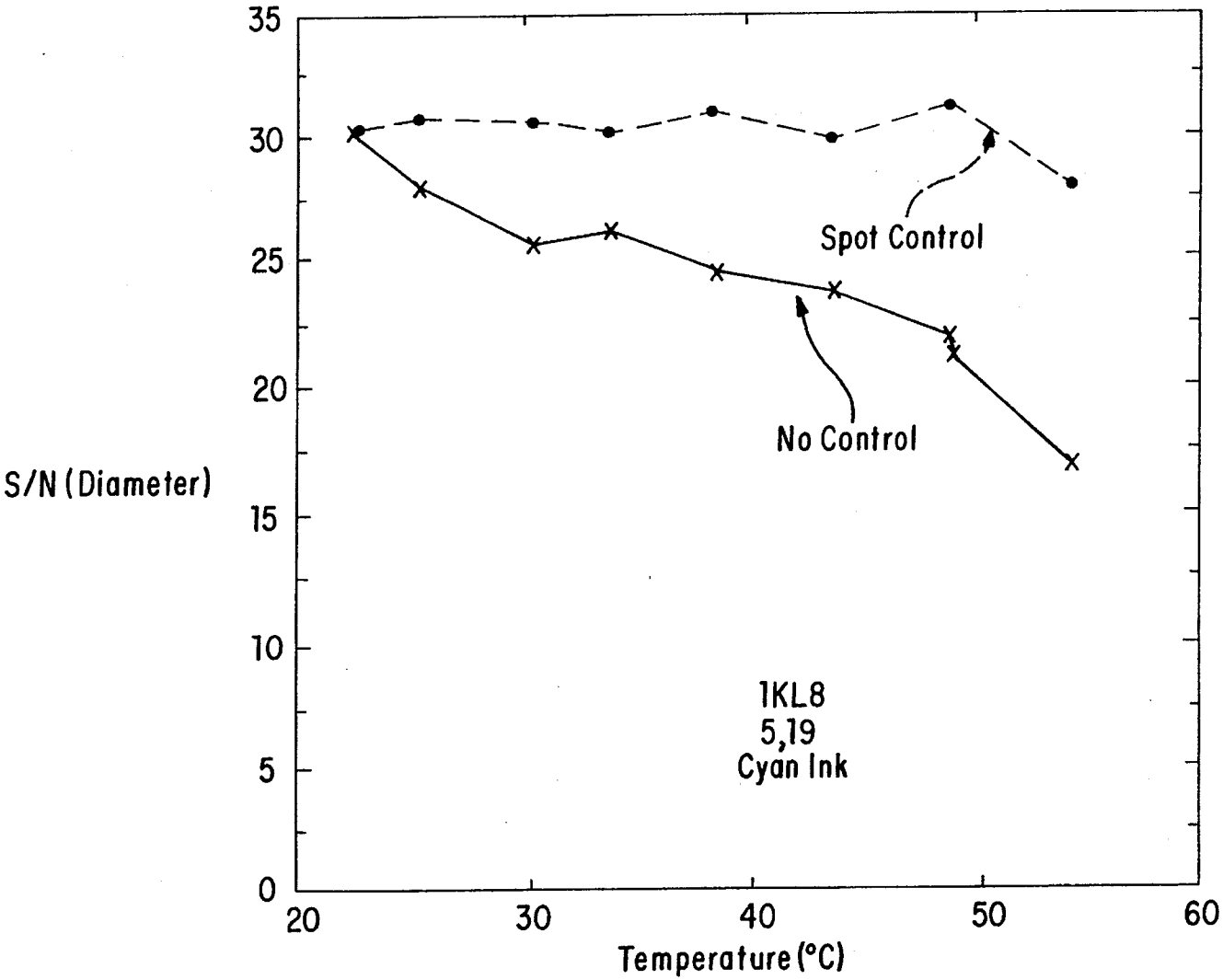
FIG. 7 is a graph of the signal to noise ratio for spot diameters versus temperature of the printhead for a printhead with no control (solid line) and a printhead with control (dashed line) according to one embodiment of this invention.

As shown in FIG. 7, the spot diameter is also more consistent across the printhead using this control. This figure shows the signal to noise ratio for spot diameters at various temperatures, as measured by a Xerox Cognex print quality measuring system (the higher the signal to noise ratio, the better). At higher temperatures, the jet performance without spot size control is less uniform, as would be expected for marginal printing conditions. Thus, spot size control not only provides more uniform spots for different temperatures, but also provides a tighter distribution of spot sizes at any single elevated temperature.

Figure 8:
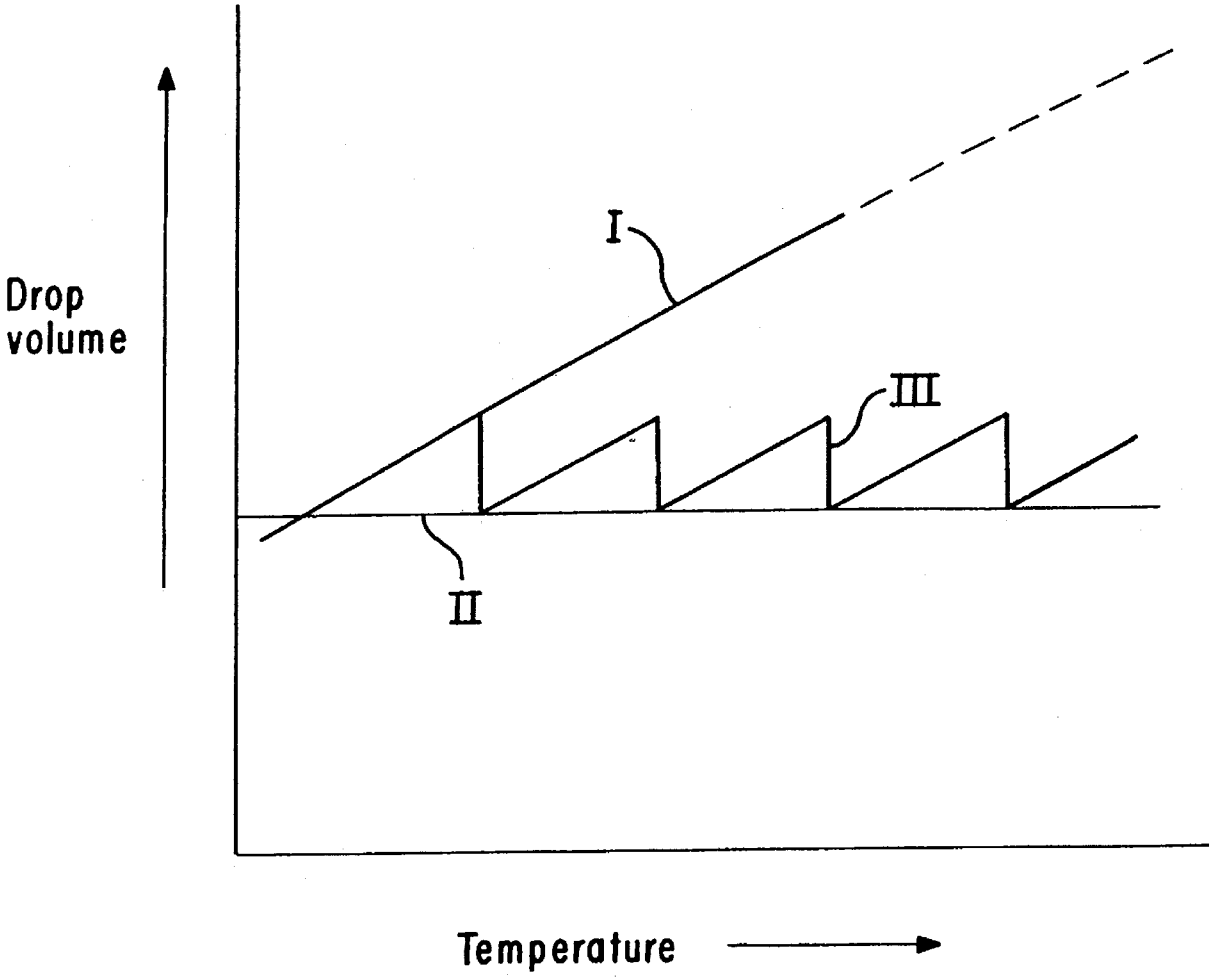
FIG. 8 is a graph of drop volume versus temperature for the cases of no control, precise control and stepped control of the preferred embodiment.

The embodiment described above with reference to FIG. 6 uses a more complex controlling system than is used in the preferred embodiment described referring to FIG. 8. FIG. 8 illustrates the difference in drop volume versus temperature for 1) no control shown as line I (missing drops are shown by the dashed line), 2) precise control as used to obtain the experimental results of FIG. 6 and shown as line II, and 3) the preferred embodiment described below as shown as line III.

With no control or compensation (i.e. no change in voltage and pulse width with temperature) the drop volume increases with temperature until volume is so large that air is ingested. With precise control or compensation, as would be required for spot size control for high quality graphics printing, the voltage and pulse width must be changed for each approximately 1° C. or less change in temperature, corresponding to approximately 1 micron of spot diameter change if no compensation is used. This would require approximately 20 to 100 different settings across the temperature range of interest. In the preferred embodiment for minimizing missing drops, it is only necessary to have a few different voltages and pulse widths (approximately 2 to 8 combinations). As the temperature increases between changing pulsing conditions, the drop volume and spot size increase correspondingly, but drop volume is always less than the volume at which ingestion and missing drops occur. In this embodiment as practiced for a scanned printhead in a desktop printer, the changing of pulse conditions can be restricted to occur between printing of subsequent pages to avoid print density changes between successive printed swaths.

Figure 9:
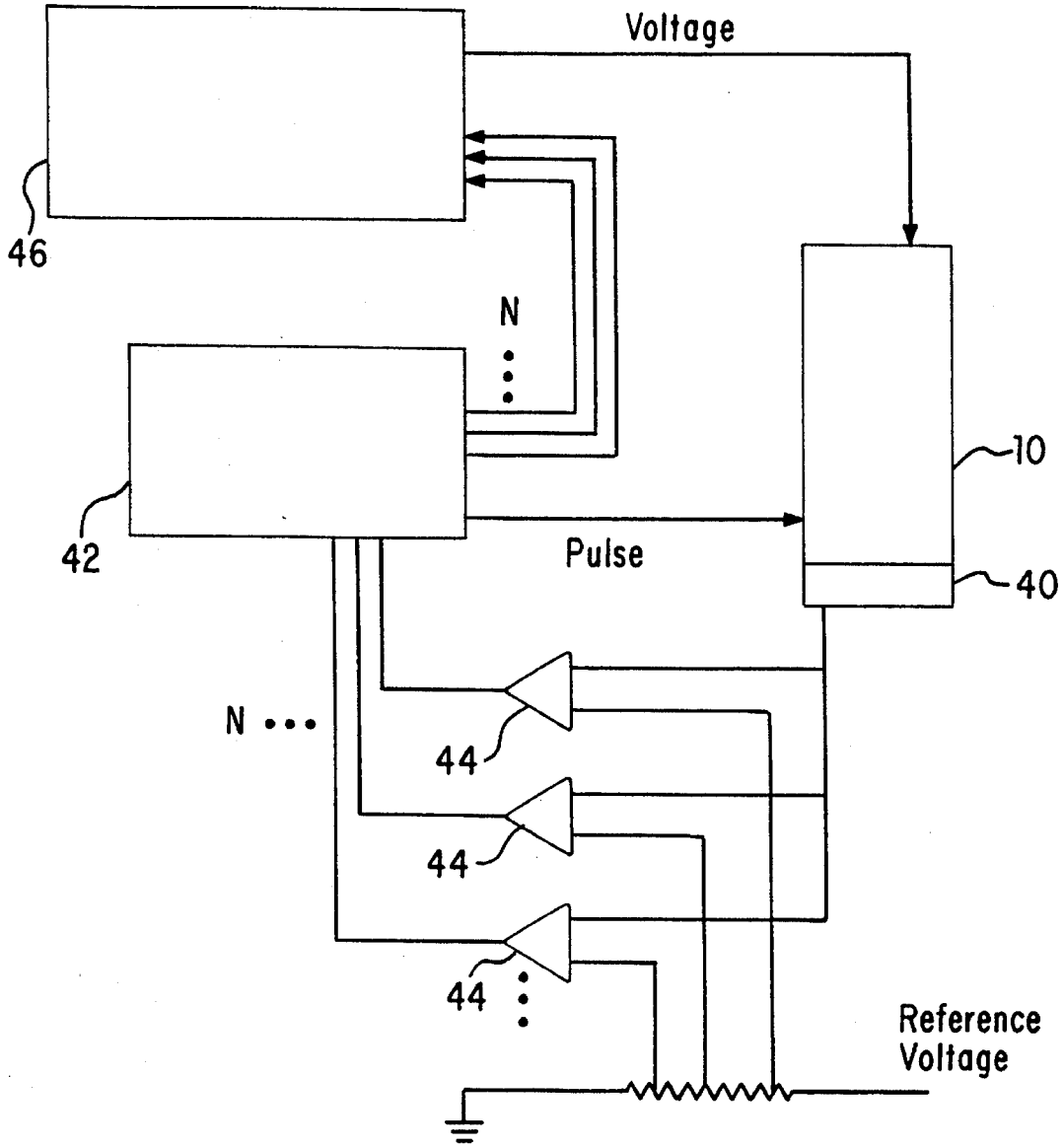
FIG. 9 is a schematic of the stepped control system of the preferred embodiment.

The preferred embodiment is further described by FIG. 9. In this system, N discrete steps of voltage and pulse width conditions are selected over the temperature range, where N is typically between 2 and 8. Because N is small, the stepped power supply 46 is simpler and cheaper than for the case of precise compensation. In addition, in this preferred embodiment, only a few levels of temperature detection are needed. This eliminates the need for a costly analog to digital converter. Temperature is measured by temperature sensor 40, and N levels are activated using comparators 44, where each comparator 44 is connected to a different reference voltage. This data is then directed to the controller 42, which then selects the pulse width and voltage to be applied to the printhead 10. Since neither the temperature nor the information directed to the stepped power supply 46 is coded in binary form, but is rather in uncoded or one-of-several form, a significant cost reduction is enabled.

Based on the foregoing control method, the inventive method and apparatus controls the printhead of a thermal ink jet printer by sensing the printhead temperature and energizing heater element 26 with a pulse of predetermined power and duration based on the sensed temperature so that the resulting spot size is near the optimum size to prevent the ingestion of air into ink channel 12. It is not necessary to measure the temperature of the heater element chip directly, but rather the temperature of the substrate thermally connected to the chip is sufficient. Once the printhead temperature is sensed, a programmed routine can consult a memorized look-up table of predetermined pulse durations and voltages for a given sensed printhead temperature, and the retrieved pulse duration and voltage can be applied to heater element 26. If the sensed temperature is greater than a predetermined temperature for a desired ink droplet size (as compared by a conventional comparator mechanism), then the pulse duration is shortened and the pulse voltage is increased to maintain the desired ink droplet size. If the sensed temperature is less than a predetermined temperature for the desired ink droplet size, then the pulse duration can be lengthened and the voltage can be decreased to maintain the desired ink droplet size. If the sensed temperature matches the predetermined temperature, then the previously applied pulse duration and voltage will maintain the desired ink droplet size.

While the present invention has been described with respect to the thermal ink jet printhead geometry sometimes called a sideshooter, as shown in FIG. 5, the invention is also applicable to other thermal ink jet printhead geometries, such as a roofshooter.

The invention has been described with reference to preferred embodiments thereof, which are intended to be illustrative and not limiting. Many modifications and variations are apparent from the foregoing description of the invention, and all such modifications are intended to be within the scope of the present invention. Accordingly, variations of the invention may be made without departing from the spirit and scope of the present invention as defined in the following claims.

We claim:

1. A method of inhibiting air entering nozzles in an ink jet printhead, which causes missing ink droplets, during printing by an ink jet printhead with a heater at elevated temperatures comprising the steps of:

sensing a temperature of the printhead; and controlling ink droplet size to minimize air entering the printhead nozzles by controlling pulsing conditions of power applied to the printhead responsive to the sensed temperature by increasing voltage supplied to the printhead at increased sensed temperatures.

2. The method of claim 1 wherein the step of controlling the ink droplet size comprises decreasing pulse width of the applied power at increased sensed temperatures.

3. The method of claim 1 wherein the step of controlling the ink droplet size comprises controlling voltage and pulse width of the applied power based on a predetermined relationship of pulse width and voltage versus temperature of the printhead.

4. The method of claim 3 wherein the step of controlling the voltage and pulse width is based on a predetermined relationship stored in a look-up table.

5. The method of claim 1 wherein the step of controlling the ink droplet size comprises selecting one level of voltage and pulse width from a range of two to eight levels of voltage and pulse width that correspond to a corresponding number of levels of sensed temperatures.

6. The method of claim 1 wherein the step of controlling the ink droplet size comprises selecting a voltage and pulse width that correspond to sensed temperatures at intervals of 5° to 25° C.

7. The method of claim 6 wherein the voltage and pulse width are selected to correspond to sensed temperatures at intervals of 10° to 20° C.

8. The method of claim 1 wherein the step of controlling ink droplet size comprises controlling voltage and pulse width of the applied power by controlling the voltage to be within a range of 2%–25% greater than a threshold voltage required to form and eject ink droplets.

9. The method of claim 8 wherein the step of controlling the voltage comprises controlling the voltage to be within a range of 7%–20% greater than the threshold voltage.

10. The method of claim 8 wherein the step of controlling the voltage comprises controlling the voltage to be approximately 10% greater than the threshold voltage.

11. A method of minimizing missing ink droplets ejected from a thermal ink jet printhead comprising the steps of:

sensing a temperature of the printhead; and controlling ink droplet volume by increasing voltage applied to the printhead to eject ink droplets when the printhead has a sensed temperature in a range higher than an average operating temperature to produce smaller ink droplets and thereby minimize air entering the printhead that causes missing ink droplets.

12. The method of claim 11, wherein the step of controlling ink droplet volume comprises decreasing pulse width of power applied to the printhead when the sensed temperature is elevated.

13. The method of claim 11, wherein the step of controlling ink droplet volume comprises increasing the voltage based on a predetermined relationship between voltage and temperature.

14. The method of claim 11, wherein the step of controlling ink droplet volume comprises increasing the voltage based on a predetermined relationship between voltage, pulse width and temperature.

15. The method of claim 11 wherein the step of controlling ink droplet volume comprises increasing the voltage based on increases of temperature in increments of approximately 5° to 25° C.

16. The method of claim 11 wherein the step of controlling ink droplet volume comprises increasing the voltage based on increases of temperature in increments of approximately 10° to 20° C.

17. An apparatus for minimizing missing droplets ejected from a thermal ink jet printhead comprising:

a temperature sensor that senses a temperature of the printhead; and a controller that controls power supplied to the printhead for actuating ink droplet ejection by varying pulsing conditions of the power by increasing voltage applied to the printhead in response to increased sensed temperatures based on a predetermined relationship between voltage and temperature.

18. The apparatus of claim 17, wherein the controller decreases pulse width responsive to increased sensed temperatures.

19. The apparatus of claim 17, wherein the controller comprises a look-up table of voltage and corresponding temperatures.

20. The apparatus of claim 17, wherein the controller increases the voltage by one voltage level from a range of two to eight voltage levels.

21. The apparatus of claim 17, wherein the controller increases the voltage based on sensed temperature increases in increments of approximately 5° to 25° C.

22. The apparatus of claim 17, wherein the controller increases the voltage based on sensed temperature increases in increments of approximately 10° to 20° C.

23. The apparatus of claim 17, wherein the printhead comprises a heater and an ink passageway that holds ink for jetting, the ink in the passageway being directly in contact with the heater, wherein the temperature sensor is coupled to the heater and the controller controls the voltage applied to the heater.

24. The apparatus of claim 17, wherein the controller changes the voltage and a pulse width of applied power between successive pages of a print job thereby avoiding noticeable print density changes between adjacent print regions on a printed page.

25. The apparatus of claim 17, further comprising at least one comparator that distinguishes between sensed temperature intervals to select increases of voltage.

* * * * *